US008171769B2

(12) United States Patent
Barthelemy et al.

(10) Patent No.: US 8,171,769 B2
(45) Date of Patent: May 8, 2012

(54) METHOD OF FORMING A FLANGED TUBULAR MEMBER IN HYDROFORMING

(75) Inventors: Bruno Barthelemy, Ann Arbor, MI (US); Ramakrishna P. Koganti, Canton, MI (US); Lawrence Anderson Queener, Pinckney, MI (US)

(73) Assignee: Ford Global Technologies, Dearborn, MI (US)

( * ) Notice: Subject to any disclaimer, the term of this patent is extended or adjusted under 35 U.S.C. 154(b) by 654 days.

(21) Appl. No.: 12/360,584

(22) Filed: Jan. 27, 2009

(65) Prior Publication Data

US 2010/0186477 A1 Jul. 29, 2010

(51) Int. Cl.
*B21D 15/03* (2006.01)
*B21D 22/02* (2006.01)

(52) U.S. Cl. ..... 72/370.22; 72/57; 72/58; 72/61

(58) Field of Classification Search ..... 72/370.22, 72/54–63

See application file for complete search history.

(56) References Cited

U.S. PATENT DOCUMENTS

| | | | |
|---|---|---|---|
| 5,070,717 A | 12/1991 | Boyd et al. | |
| 6,467,146 B1 | 10/2002 | Herman | |
| 6,584,689 B2 | 7/2003 | Bruggemann et al. | |
| 6,672,151 B1 | 1/2004 | Schultz | |
| 6,722,009 B2 | 4/2004 | Kojima et al. | |
| 6,739,166 B1 * | 5/2004 | Shah | 72/57 |
| 7,051,768 B2 | 5/2006 | Takahashi | |

FOREIGN PATENT DOCUMENTS

| | | |
|---|---|---|
| JP | 2004/276032 | 10/2004 |
| JP | 2006175521 A * | 7/2006 |

OTHER PUBLICATIONS

Ahmetoglu, Mustafa, "The basic elements of tubular hydroforming," The Fabricator, Mar. 5, 2001, http://www.thefabricator.com/Hydroforming/Hydroroming_Article.cfm?ID=28, 4 pages.

Brinks, Paul, "Exploring the Hydroforming Process," http://claymore.engineer.gvsu.edu/~brinksp/hydroforming.html, 2 pages, Jul. 20, 1997.

* cited by examiner

*Primary Examiner* — Jessica L Ward
*Assistant Examiner* — Kevin E Yoon
(74) *Attorney, Agent, or Firm* — Gigette M. Bejin; Fredrick Owens

(57) ABSTRACT

A method of forming a flanged tubular member includes the steps of: positioning a tubular blank in a die; applying nominal pressure; closing the dies; and increasing pressure within the blank, thereby converting the tubular blank to a hydroformed member having the flange and a hem with a cavity therein. The die halves define: a die tubular cavity portion; a die hem cavity portion; and a die flange cavity portion. Upon closing the die halves with nominal pressure and then increasing pressure, (1) the blank is deformed within the die tubular cavity portion; (2) the flange is defined from a portion of the blank in the die flange cavity portion; and (3) at least an intermediate hem is defined in the die hem cavity portion.

11 Claims, 3 Drawing Sheets

REMOVE BLANK AND INSERT IN FINAL DIE

METHOD OF FORMING A FLANGED TUBULAR MEMBER IN HYDROFORMING

BACKGROUND

The present disclosure relates generally to a tube hydroforming process.

Hydroforming is a cost-effective way of shaping malleable metals into lightweight, structurally stiff and strong pieces. Non-limiting examples of malleable metals include aluminum or steel. One of the largest applications of hydroforming is the automotive industry, which makes use of the complex shapes possible by hydroforming to produce stronger, lighter, and more rigid unibody structures for vehicles. This technique is also particularly popular with the high-end sports car industry, and is also frequently employed in the shaping of tubes for bicycle frames.

The tubular hydroforming process involves the application of fluid pressure to the inside of a tubular blank, which is captured within a mold cavity that defines the shape of the finished part. The internal fluid pressure is then increased to force the tubular blank to expand into conformance with the mold cavity, thus taking the shape of the finished part.

Accordingly, hydroforming is a specialized type of die forming that uses a high pressure hydraulic fluid to press working material into a die. To hydroform material into a vehicle's frame rail, a hollow tube is placed inside a negative mold that has the shape of the desired end part. High pressure hydraulic pistons may then inject a fluid at very high pressure inside the material which causes it to expand until it matches the mold. The hydroformed member is then removed from the mold.

Hydroforming allows complex shapes with concavities to be formed, which would be difficult to manufacture with standard solid die stamping. Furthermore, hydroformed parts can often be made with a higher stiffness-to-weight ratio and at a lower per unit cost than traditional stamped or stamped and welded parts.

In a traditional hydroforming process, a male die and a blank holder is generally used. There is generally no need to fit a female die to the punch, which means that more complex shapes can be easily formed. The single die setup also improves the speed at which die changes can be made. Since the pressure is adjusted on a continuous basis, parts which might take two or three conventional deep draws can be done in one hydroforming operation.

A flexible diaphragm helps eliminate the marks that are usually formed in deep drawing operations. This reduces costs that are related to the finishing of the final part. Due to the fact that the metal is not bent or stretched but formed around the punch, the material thin-out in the walls of the part is usually less than 10%. Thus, thinner blanks can be used to form the parts desired. This is advantageous, e.g., when using expensive materials or when the weight of a component must be carefully controlled, as in the aerospace or automotive industry. At the same time, the material is not work-hardened in a hydroforming process as it would be for a normal drawing process, so the end part usually does not have to be annealed.

Since it is not necessary to form the punch from hardened steel, cast iron is usually used to make the punch and blank holder. This material is easily machinable and has a long lifespan.

Some of the difficulties surrounding hydroforming processes are the pressures involved in forming the piece. Because the pressures involved are usually three to four times those normally associated with deep drawing, attention is generally paid to the pressure vessel to prevent fluid leaks. If too little pressure is applied, the blank may wrinkle, resulting in poor quality. If too much pressure is applied, the blank may sheer, and the part will have to be scrapped.

SUMMARY

A method for hydroforming a member with a flange according to embodiment(s) disclosed herein includes the steps of: positioning a tubular blank in a die; applying nominal pressure and closing the dies to form an intermediate hem; and increasing pressure within the blank, thereby converting the tubular blank to a hydroformed member having the flange and a hem with a cavity therein. The die halves define: a die tubular cavity portion; a die hem cavity portion; and a die flange cavity portion. Upon closing the die halves with nominal pressure and then increasing the pressure, (1) the blank is deformed within the die tubular cavity portion; (2) the flange is defined from a portion of the blank in the die flange cavity portion; and (3) a hem is defined in the die hem cavity portion.

BRIEF DESCRIPTION OF THE DRAWINGS

Features and advantages of embodiments of the present disclosure will become apparent by reference to the following detailed description and drawings, in which like reference numerals correspond to similar, though perhaps not identical components. For the sake of brevity, reference numerals or features having a previously described function may or may not be described in connection with other drawings in which they appear.

DETAILED DESCRIPTION

Given the nature of the hydroforming process, it can be challenging to create structures that are formed from traditional stamping or roll forming methods such as joining structures between different hydroform members or creating robust flanges on hydroform members. The inventors of the present disclosure further discovered that cracking may occur where flanges are formed in the die during the hydroforming process. Cracking may specifically occur where the material folds upon itself to create a flange. Cracking may be prevalent in materials that have a lower ductility but have higher strength characteristics such as, for example, advanced high strength steels. Examples of such high strength steels include Dual Phase (DP) 780 or higher grades steel tubes.

Flanges may be desirable to provide a mounting structure for another part such as, but not limited to, a seal or another member. The configuration of a flange or flange-like structure coupled with the high pressure hydroforming process may render undesirable results, such as cracking in the material, which may affect the operating characteristics of the component. As indicated, cracking in the material at such locations has been discovered in various materials, including but not limited to the DP780 material mentioned above. Accordingly, the present inventors have discovered a method for forming a tubular member with a flange, which method substantially prevents or eliminates cracking in the material.

Figure 1A:
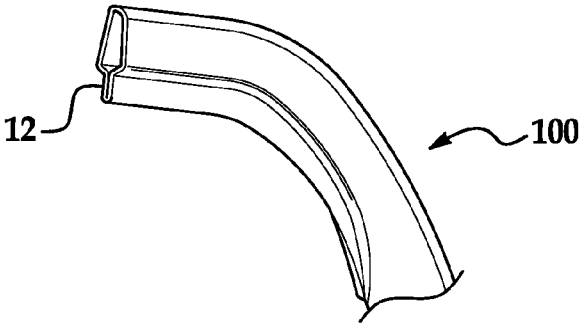
FIG. 1A PRIOR ART
FIG. 1A is a cutaway perspective front view of a hydroformed member of the prior art where the prior art hydroformed member has a folded flange.
Figure 1B:
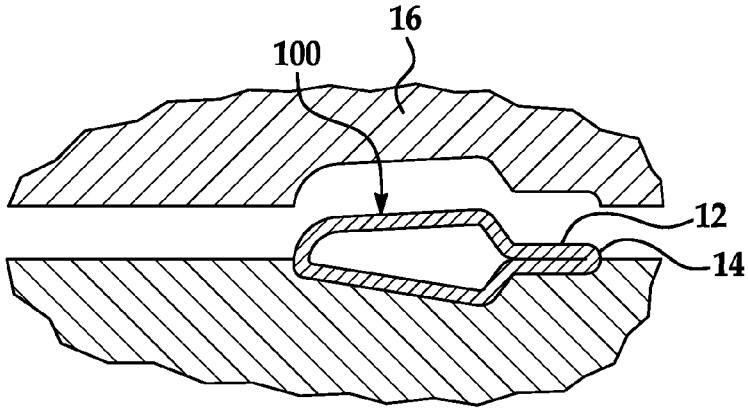
FIG. 1B PRIOR ART
FIG. 1B is a cutaway cross sectional view of a prior art hydroformed member having a folded flange extending along at least a portion of the length thereof.
Figure 2:
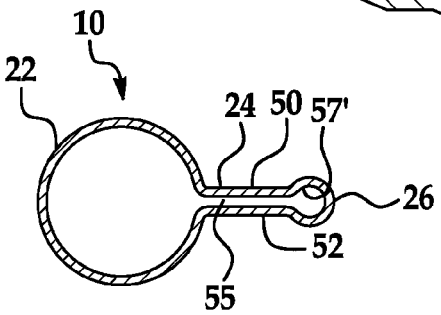
FIG. 2 is a cross sectional view of an embodiment of the present disclosure.

Referring now to FIGS. 1A and 1B together, a hydroformed member 100 of the prior art is shown. The prior art hydroformed member 100 has a flange 12 where the material is directly folded upon itself at an edge 14 within the die 16 as shown in FIG. 2. Undesirable characteristics such as cracking generally occur in the region or edge 14 where the material is directly folded upon itself. The stress imposed upon the material in this region or edge 14 may be significant due to the physical and geometrical configuration and/or due to the high pressure imposed on the part in the hydroforming process. Moreover, if the material has insufficient ductility characteristics to withstand such stresses, the material is more likely to crack. The stress to the material may result in cracks which may affect the physical characteristics of the component and may further compromise the hydroforming process wherein the fluid leaks out of the blank. The blank material may further wrinkle where there is inadequate pressure due to fluid leakage.

Figure 7:
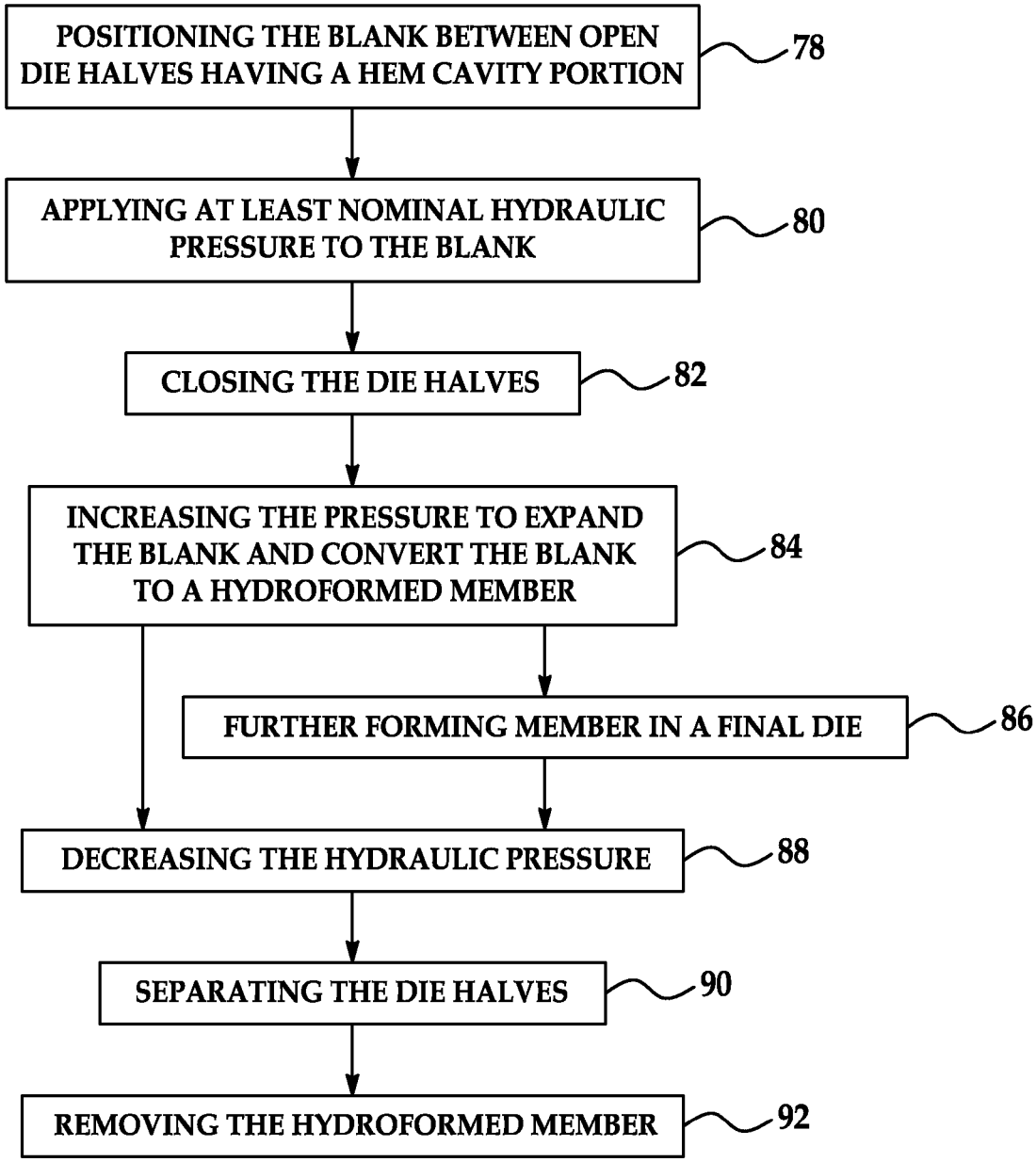
FIG. 7 is a flow chart which illustrates two embodiments of the present disclosure.

Accordingly, referring now to FIG. 7, two embodiments of the present disclosure are illustrated. FIG. 7 shows two methods of forming a flanged hydroformed member which includes the steps of: positioning the blank, as depicted at reference numeral 78; applying pressure as depicted at reference numeral 80; closing the die halves to deform the blank in three regions of the die so that an intermediate hem and an intermediate tubular portion is formed as depicted at reference numeral 82; increasing the hydraulic pressure to expand and conform the blank to the cavities within the die as depicted at reference numeral 84; decreasing the hydraulic pressure as depicted at reference numeral 88; separating the die halves as depicted at reference numeral 90; and removing the blank from the die as depicted at reference numeral 92.

Alternatively, FIG. 7 shows the steps of: positioning the blank as depicted at reference numeral 78; applying pressure as depicted at reference numeral 80; closing the die halves to deform the blank in three regions of the die as depicted at reference numeral 82; increasing the hydraulic pressure to expand and conform the blank to the cavities within the die as depicted at reference numeral 84; further forming the member in a final die as depicted at reference numeral 86; decreasing the hydraulic pressure as depicted at reference numeral 88; separating the die halves as depicted at reference numeral 90 and removing the blank from the final die as depicted at reference numeral 92.

It is to be understood that the application of the pressure as in step 80 mentioned above may be any suitable nominal fluid pressure. In a non-limiting embodiment, the nominal fluid pressure may range from about 500 psi to about 1,500 psi. Furthermore, as the hydraulic pressure is increased, e.g., as in step 84 mentioned above, the fluid pressure may be any suitable fluid pressure. In a further non-limiting embodiment, the fluid pressure may increase up to about 10.00 psi.

Figure 3:
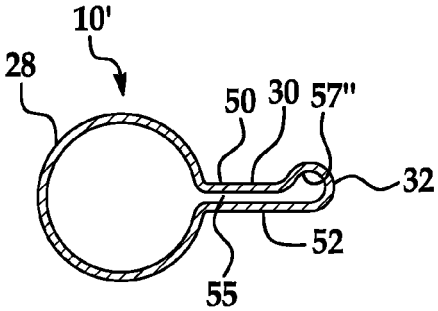
FIG. 3 is a cross sectional view of another embodiment of the present disclosure.
Figure 4:
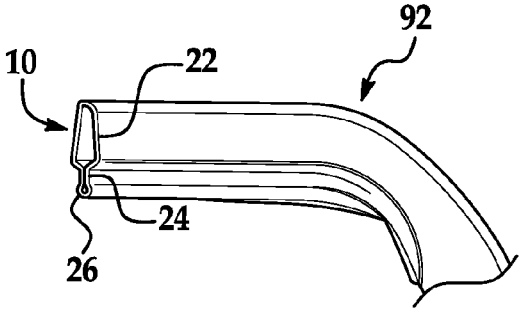
FIG. 4 is a cutaway perspective front view of a hydroformed member implementing the embodiment of FIG. 2.

Referring now to FIGS. 2-4 together, a closed hydroformed member 10 (FIGS. 2 and 4), 10' (FIG. 3) is depicted after these components 10, 10' have undergone embodiments of the method of the present disclosure. A first region of the hydroformed member 10, 10' is the tubular or larger portion 22, 28. A second region is the flange portion 24, 30 and the third region is the hem 26, 32 or hem region of the flange portion 24, 30. The hems 26, 32 in the hydroformed members 10, 10' each include a cavity 57', 57". It is also to be understood that there may be a gap 55 within the flange portions 24, 30 of the hydroformed members 10, 10'.

Figure 8:
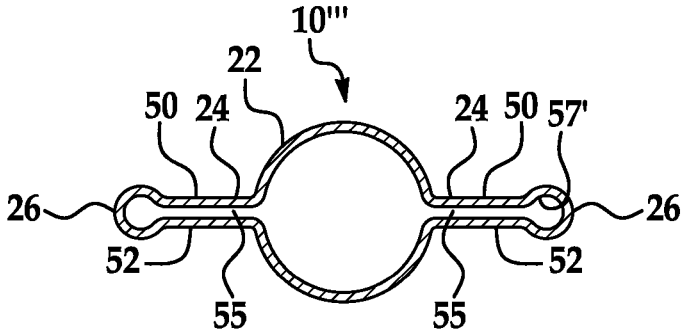
FIG. 8 is a cross sectional view of another embodiment of the present disclosure

Referring now to FIG. 8, the closed hydroformed member 10 is depicted where multiple flange portions 24 are shown. Similar to the closed hydroformed member 10, 10' of FIGS. 2 and 3, a first region is the tubular or larger portion 22. Secondary regions are flange portions 24 shown in FIG. 8. Moreover, similar to the closed hydroformed member shown in FIGS. 2 and 3, the flange portions 24 each includes a hem 26 or hem region for each flange portion 24.

Figure 6A:
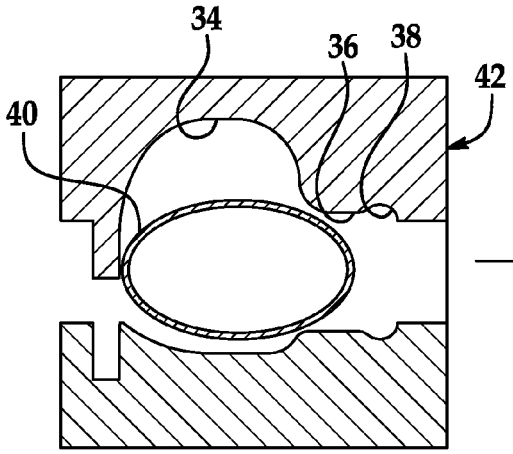
FIG. 6A is a cross-sectional view of another embodiment of a tubular blank as it is being installed in the a die prior to closing the die.

Referring now to FIG. 2 and to FIG. 6A, the tubular portion 22 corresponds to, and is formed in a die tubular cavity 34 or larger cavity of the die. In a non-limiting embodiment, the die tubular cavity 34 may have a height that is approximately 4 times larger than the height of the die hem cavity region 38. The flange portion 24 corresponds to and is formed in the die flange cavity portion 36 of the die 42. The hem region 26 corresponds to and is formed in the die hem cavity region 38.

Figure 6B:
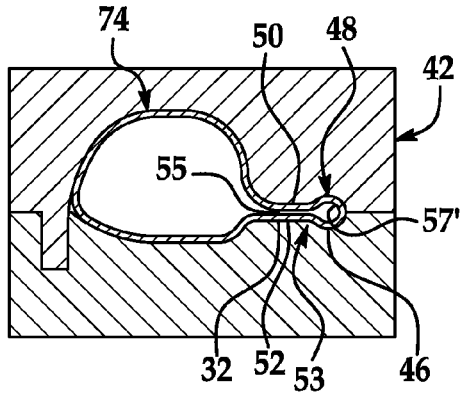
FIG. 6B is a cross sectional view of the embodiment of FIG. 6A after the blank has been hydroformed to its desired shape.

With reference to the one step method of FIGS. 6A and 6B, the open halves of die 42 mate with one another to define a die tubular cavity portion 34, a die hem cavity portion 38, and a die flange cavity portion 36. Once the blank or tubular blank 40 is operatively positioned in the three die cavity regions 34, 36, 38, at least nominal internal hydraulic pressure is applied to the tubular blank 40. The die halves 42 are further closed to deform the blank 40 within the tubular cavity portion 34. The closure of the die halves 42 coupled with the application of at least nominal pressure causes the tubular blank 40 to be deformed within the die tubular cavity portion. Moreover, a flange 53 is defined from a portion of the tubular blank 40 in the die flange cavity portion 36, and at least an intermediate hem is formed (not shown) in the die hem cavity 38. As the die halves 42 continue to close and/or the pressure of the fluid increases, the die halves 42 compress the blank 40 to define a flange 53 in the flange cavity portion 36. The die halves 42 having the die hem cavity portion 38, also define a hem 48 at one end of the flange 53 shown in FIG. 6B as the increased fluid pressure is applied to the tubular blank 40. The hem 48 includes a cavity 57' therein.

Figure 5A:
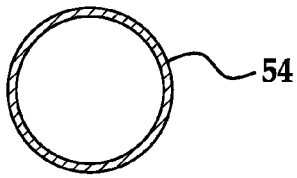
FIG. 5A is a cross-sectional view of an embodiment of a tubular blank prior to the hydroforming process.

The blank 40 shown in FIG. 6A has an oval shaped cross-section to facilitate the manufacturing process. However, it is to be understood that the oval blank 40 is a non-limiting example. A circular cross section 54 as shown in FIG. 5A, as well as other cross sections are contemplated as being within the purview of the present disclosure. It is to be understood that an oval blank 40 may facilitate a one-step hydroforming process wherein one die 42 may be implemented without a final die.

As indicated, the hydraulic pressure increases to expand and conform the tubular blank 40 to the die tubular cavity portion 34 and the die hem cavity portion 38 such that the tubular blank 40 material is not overstrained. Unlike the prior art hydroformed member 100 that is folded upon itself as shown in FIGS. 1A and 1B, embodiments of the method of the present disclosure implement a dual cavity die, e.g., die 42 and die 58 (discussed below). The hem cavity 38 is the smaller cavity that forms the hem in the blank 40 so that other components such as a seal (not shown) or other body structural components may be joined to the part.

It is to be understood that the general use of tube-like, single component structures in the hydroforming process presents issues for forming secondary structures, such as a flange 53 or mounting surfaces, on a single tubular hydroformed part. The present disclosure provides a robust solution to forming such a secondary structure such as a flange 24, 30, 53 on a tubular hydroformed region 22, 28.

It is to be understood that the dual cavity die 42 shown in FIGS. 6A and 6B is a non-limiting example, and other configurations of a die 42 having dual cavities 34, 38 may be implemented. It is also to be understood that the die hem cavity 38 is significantly smaller than the die tubular cavity 34, as mentioned herein.

Accordingly, the die 42 may be formed such that the die hem cavity portion 38 and the associated hydroform pressure may create a small symmetrical bulb-like region 46 in the hem portion 48 of the hydroformed member. This symmetrical bulb-like region 46 is also shown as hem 26 in FIG. 2. It is also to be understood that the die hem cavity portion 38 may be alternatively configured to create an asymmetrical bulb-like region 32 (FIG. 3) in the hem portion 32 of the hydroformed member 10'. It is to be understood that the resulting hem portion 26, 32, 48 is small enough in diameter so that the hem portion 26, 32, 48 may serve as a mounting structure for the larger tubular portion 22, 28 so that another member such as a seal (not shown) may be mounted on the hem portion 26, 32, 48 and its associated flange 53, 24, 30; or another body structure component or the like may be mounted on the hem portion 26, 32, 48 and its associated flange 53, 24, 30. The tubular region 22, 28 of the hydroformed member 10, 10' may generally be the primary use of the component such as in the non-limiting example of the tubular region 22, 28 being an A-pillar 92 (shown in FIG. 4) for a vehicle (not shown).

Accordingly, with reference to FIG. 6B, once the blank 40 has been deformed to the desired shape through the fluid pressure and the die 42, the die halves 42 are separated so that the hydroformed member 74 may then be removed from the die 42. It is also to be understood that as the tubular blank 40 is being conformed to the shape of the die 42, the tubular blank 40 is being converted to a hydroformed member 74.

As non-limiting examples of the hem 68, 48 described above, a rope hem 64 or a bulb like structure may be created. The wall portions 50, 52 in the flange region may be welded together to define the flange 66. It is to be understood that the wall portions 50, 52 of the flange may also be flush against one another as shown in FIG. 5C, or may have a small gap 55 between the wall portions 50, 52 as shown in FIG. 6B.

As a non-limiting example, the flange cavity portion 36 may further include a region having a height substantially equal to two times the wall thickness 41 of the blank 40 so that the wall portions 50, 52 will be flush against one another upon removal from the die 42, 44. Embodiments of the method of the present disclosure may further include the step of welding together or otherwise adhering the wall portions 50, 52 that define the flange 53.

It is to be understood that the wall thickness 41 of the blank 40 may be any suitable thickness. In an embodiment, this wall thickness 41 may range from about 1.5 mm to about 2.0 mm. It is to be further understood that any suitable materials may be used to form the blank 40. In a non-limiting example, the materials for the blank may be selected from High Strength Low Alloy Steel, Dual Phase Steel, TRIP Steels and Martensite Steel and combinations thereof.

Figure 5B:
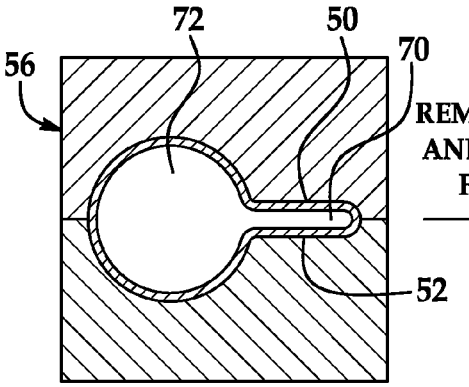
FIG. 5B is a cross-sectional view of the embodiment of the blank of FIG. 5A positioned in an example of a pre-form die, depicting the blank pre-formed, and prior to transferring the pre-form to a final die.
Figure 5C:
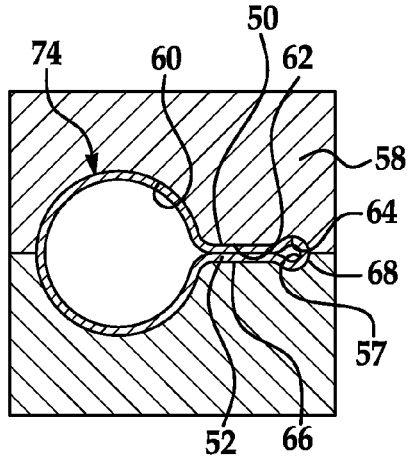
FIG. 5C is a cross-sectional view of an embodiment of the hydroformed member in the final die after the final hydroforming process has been performed.

Referring now to FIGS. 5B and 5C, an alternative method of the present disclosure may include a two step process where the tubular blank 54 is formed in a pre-form die 56 and a final die 58. This embodiment includes the steps of providing a tubular blank 54; positioning the tubular blank 54 between open halves of pre-form die 56; applying at least nominal pressure to the tubular blank 54; closing the pre-form die 56 and increasing the hydraulic pressure to expand the tubular blank 54 to an intermediate form 53; decreasing pressure; transferring the intermediate form 53 to a final die 58; positioning the intermediate form 53 between the final die halves 58; applying at least nominal internal hydraulic pressure to the intermediate form 53; closing the final die halves 58 to deform the intermediate form 53 within the tubular cavity portion 60, thereby defining a flange 66 in the die flange cavity portion 62, and defining an intermediate hem (not shown) in the die hem cavity portion 64. The hydraulic pressure is then increased to expand and conform the intermediate form 53 to the tubular cavity portion 60 and the hem cavity portion 64 so that hem 68 is formed and defines therein a cavity 57. The hydraulic pressure is then decreased, and the final die halves 58 are separated so that the hydroformed member 74 may be removed from the final die 58.

It is to be understood that the pre-form die halves 56 mate with one another to define an intermediate die flange cavity portion 70 and an intermediate die tubular cavity portion 72. It is also to be understood that the final die halves 58 mate with one another to define a die flange cavity portion 62, a die tubular cavity portion 60; a die hem cavity portion 64; and a die flange cavity portion 62.

As the step of increasing the hydraulic pressure to expand and conform the intermediate form 53 to the die tubular cavity 60 is performed, the intermediate form 53 is being converted to the desired hydroformed member 74 having a flange 66 and hem 68 with a cavity 57 therein.

While several embodiments have been described in detail, it will be apparent to those skilled in the art that the disclosed embodiments may be modified. Therefore, the foregoing description is to be considered exemplary rather than limiting.

What is claimed is:

1. A method of forming a flanged tubular member, comprising the steps of:

positioning a tubular blank between open, mating die halves, the tubular blank having an interior surface and an outer surface with a wall therebetween, the die halves defining:

a die tubular cavity portion;

a die hem cavity portion; and a die flange cavity portion; then applying at least nominal internal hydraulic pressure to the blank interior;

closing the die halves, thereby substantially simultaneously:

deforming the blank within the die tubular cavity portion;

defining a flange from a first portion of the blank in the die flange cavity portion; and defining at least an intermediate hem from a second portion of the blank in the die hem cavity portion; and increasing the hydraulic pressure to expand and conform the outer surface of the blank to the die tubular cavity portion and the die hem cavity portion, thereby converting the tubular blank to a hydroformed member having the flange and a hem with a cavity therein.

2. The method as defined in claim 1 wherein the hem is a rope hem.

3. The method as defined in claim 1 wherein the flange includes two opposing walls, and wherein the method further comprises the step of welding together the flange walls.

4. The method as defined in claim 1 wherein the die flange cavity portion includes a region having a height substantially equal to two times the tubular blank wall thickness.

5. The method of claim 1 wherein the hem is operatively configured to receive a seal.

6. The method as defined in claim 5 wherein the hem is a rope hem.

7. The method as defined in claim 5 wherein the flange cavity portion includes a region having a height substantially equal to two times the wall thickness of the blank.

8. The method as defined in claim 1, further comprising the steps of:

decreasing the hydraulic pressure;

separating the die halves; and removing the hydroformed member from the die.

9. The method as defined in claim 5, further comprising the steps of:

decreasing the hydraulic pressure;

separating the die halves; and removing the hydroformed member from the die.

10. A method of forming a flanged tubular member, comprising the steps of:

positioning a tubular blank between open, mating pre-form die halves, the tubular blank having an interior surface and an outer surface with a wall therebetween, the pre-form die halves defining:

a tubular cavity portion; and an intermediate flange cavity portion; then applying at least nominal internal hydraulic pressure to the blank interior;

closing the die halves, thereby substantially simultaneously;

deforming the blank within the pre-form die tubular cavity portion;

defining an intermediate flange from a portion of the blank in the pre-form die flange cavity portion;

increasing the hydraulic pressure to expand and conform the blank to the tubular cavity portion and the intermediate flange cavity portion;

decreasing the hydraulic pressure;

separating the pre-form die halves;

transferring the pre-formed blank to a final die;

positioning the pre-formed blank between open mating final die halves, the pre-formed blank having an interior pre-formed surface and an outer pre-formed surface with a pre-formed wall therebetween, the final die halves defining:

a final die tubular cross section cavity portion;

a final die flange cavity portion; and a final die hem cavity portion; then applying at least nominal internal hydraulic pressure to the pre-formed blank;

closing the final die halves, thereby substantially simultaneously:

deforming the pre-formed blank within the final die tubular cavity portion;

defining a flange in the final die flange cavity portion;

defining an intermediate final hem in the hem flange cavity portion;

increasing the hydraulic pressure to expand and conform the outer surface of the preformed blank to the final die tubular cavity portion and the final die hem cavity portion, thereby converting the pre-formed blank to a final hydroformed member having a flange and a hem with a cavity therein.

11. The method as defined in claim 10, further comprising the steps of: decreasing the hydraulic pressure;

separating the die halves; and removing the hydroformed member from the die.

* * * * *